US011346052B2

(12) United States Patent
Backfolk et al.

(10) Patent No.: US 11,346,052 B2
(45) Date of Patent: May 31, 2022

(54) SURFACE TREATMENT COMPOSITION

(71) Applicants: Kaj Backfolk, Lappeenranta (FI); Isto Heiskanen, Imatra (FI); Nina Miikki, Imatra (FI)

(72) Inventors: Kaj Backfolk, Lappeenranta (FI); Isto Heiskanen, Imatra (FI); Nina Miikki, Imatra (FI)

(73) Assignee: Stora Enso OYJ, Helsinki (FI)

( * ) Notice: Subject to any disclaimer, the term of this patent is extended or adjusted under 35 U.S.C. 154(b) by 197 days.

(21) Appl. No.: 16/679,660

(22) Filed: Nov. 11, 2019

(65) Prior Publication Data

US 2020/0071883 A1 Mar. 5, 2020

Related U.S. Application Data

(62) Division of application No. 13/577,114, filed as application No. PCT/IB2011/050578 on Feb. 11, 2011, now Pat. No. 10,619,304.

(30) Foreign Application Priority Data

Feb. 11, 2010 (SE) ..... 1000132-9

(51) Int. Cl.

| | |
|---|---|
| ***D21H 17/66*** | (2006.01) |
| ***D21H 17/50*** | (2006.01) |
| ***D21H 17/00*** | (2006.01) |
| ***D21H 17/60*** | (2006.01) |
| *D21H 21/54* | (2006.01) |
| *D21H 19/44* | (2006.01) |
| *D21H 23/56* | (2006.01) |
| *D21H 21/16* | (2006.01) |

(52) U.S. Cl.

CPC ..... *D21H 17/66* (2013.01); *D21H 17/60* (2013.01); *D21H 17/71* (2013.01); *D21H 17/74* (2013.01); *D21H 19/44* (2013.01); *D21H 21/16* (2013.01); *D21H 21/54* (2013.01); *D21H 23/56* (2013.01); *Y10T 428/24893* (2015.01)

(58) Field of Classification Search

None

See application file for complete search history.

(56) References Cited

U.S. PATENT DOCUMENTS

| | | | | |
|---|---|---|---|---|
| 3,287,154 | A | 11/1966 | Haas | |
| 4,020,210 | A * | 4/1977 | Geer | G03G 7/006 430/104 |
| 4,091,130 | A | 5/1978 | Shaw | |
| 4,717,638 | A | 1/1988 | Mikami et al. | |
| 5,336,582 | A | 8/1994 | Takegawa et al. | |
| 5,541,633 | A * | 7/1996 | Winnik | C09D 11/328 106/31.15 |
| 5,824,462 | A | 10/1998 | Ashida | |
| 5,880,062 | A * | 3/1999 | Sanders | B41M 5/52 503/201 |
| 6,207,258 | B1 | 3/2001 | Varnell | |
| 6,228,161 | B1 * | 5/2001 | Drummond | D21H 17/67 106/464 |
| 2002/0104632 | A1 | 8/2002 | Jimenez | |
| 2003/0059601 | A1 | 3/2003 | Tokiyoshi et al. | |
| 2005/0013946 | A1 | 1/2005 | Bringley et al. | |
| 2007/0113997 | A1 | 5/2007 | Glittenberg | |
| 2007/0145618 | A1 | 6/2007 | Finney et al. | |
| 2008/0139726 | A1 | 6/2008 | Eisermann et al. | |

FOREIGN PATENT DOCUMENTS

| | | |
|---|---|---|
| CN | 101205310 | 6/2008 |
| EP | 0829374 | 3/1998 |
| EP | 2192231 | 6/2010 |
| FR | 2939442 | 6/2010 |
| GB | 2015611 | 9/1979 |
| GB | 2201171 | 8/1988 |
| WO | 2005068916 | 7/2005 |
| WO | 2008048265 | 4/2008 |

OTHER PUBLICATIONS

International Search Report for PCT Application No. PCT/IB2011/05078, dated May 12, 2011.

http://www.sigmaaldrich.com/content/sigma-aldrich/docs/Aldrich/General_Information/thermal_transitions_of_homopolymers.pdf (2015).

* cited by examiner

*Primary Examiner* — Dennis R Cordray

(74) *Attorney, Agent, or Firm* — Greer, Burns & Crain, Ltd.

(57) ABSTRACT

A surface treatment composition for paper, board or other fibrous webs. The composition of the invention comprises particles which comprise an active material and a supporting material. The active material comprises a salt of a multivalent metal, such as a divalent or trivalent metal. In accordance with the invention, the supporting material is adapted to release the active material from the particles when subjected to heat and/or pressure and/or a change in pH. Consequently, the active material's adverse effects on the rheology of the composition are avoided while its desired effects on the surface characteristics are retained or enhanced.

8 Claims, No Drawings

SURFACE TREATMENT COMPOSITION

RELATED APPLICATIONS

This application is a divisional application of U.S. Ser. No. 13/577,114 filed on Aug. 3, 2012, which is a U.S. National Phase under 35 U.S.C. § 371 of International Application No. PCT/IB2011/050578, filed Feb. 11, 2011, which claims priority under 35 U.S.C. §§ 119 and 365 to Swedish Application No. 1000132-9, filed Feb. 11, 2010.

TECHNICAL FIELD

The present invention relates to a surface treatment composition intended for the coating or sizing of paper, board or other fibrous webs.

BACKGROUND OF THE INVENTION

Paper, board and other fibre-based webs are often surface sized, pigmented or mineral coated to improve characteristics of the paper that affects the printability, such as the surface porosity, the absorptivity, the wettability, or the surface energy (the ink adhesion) of the paper. Today, the printability of uncoated paper is often optimized by the addition of additives to the surface-size or pigmentation recipe. The printability of coated paper is often optimized by optimizing the pigment characteristics, the amount and kind of binders used or by adding additives to the coating compositions. One problem with the addition of additives is that the additives are not always compatible with the other components in the coating, pigmentation or sizing composition.

New printing techniques, such as ink jet printing, puts high demands on the printing paper, since the ink must be quickly dried on the substrate and yet provide a high print quality. A desired quality involves a high optical print density, minimized feathering and bleeding and low strike-through. In recent years it has been found that when multivalent salts, such as calcium chloride, are added to the surface size, the applied ink will precipitate fast on the surface of the paper and give rise to a significant improvement in print quality. This is especially advantageous in ink jet printing. U.S. Pat. No. 6,207,258 discloses a composition useful for surface treating a sheet substrate for ink jet printing, the composition comprising a salt of a divalent metal.

Multivalent cations, e.g. calcium, are sometimes added to sizing or coating compositions in the form of lubricants, e.g. calcium stearate. However, the concentration of calcium, in e.g. calcium stearate is not high enough to give rise to the desired effects on the print quality. Thus, the calcium amounts needs to be higher than traditionally used in such products in order to improve the print quality.

One problem with the addition of multivalent salts to coating and/or sizing compositions is that the high concentration of salt needed to achieve the desired effects oftentimes causes rheology problems and undesired precipitations. This is especially a problem when high amounts, such as 0.5-5 parts of salt, is added to anionically charged sizing, pigmentation or coating compositions. Multivalent cations interact strongly with typical anionic-charged polymers or minerals, or additives which are used in papermaking. The stability of anionically charged particles can be improved by e.g. providing steric or electrosteric stability. However, high amounts of electrolytes may cause colloidal flocculation and precipitation.

The printability may further be improved by lowering the pH of a sizing or a coating layer composition e.g. by addition of an acid to the coating or sizing composition. However, not all sizing or coating agents are compatible with low pH. Calcium carbonate pigments can for example not be used at low pH since calcium carbonate dissolves and foam is generated when calcium dioxide is released from calcium carbonate in an acid environment. A reduction in pH may also have a negative impact on rheological properties and on the runnability of the paper machine.

It is an object of the present invention to find a solution to the problem of adding additives, such as salts of multivalent metals, to sizing and/or coating compositions without disturbing the rheological profile of the composition.

SUMMARY OF THE INVENTION

The above object, and other advantages, is achieved by the surface treatment composition and the process of the present invention.

The invention relates to a surface treatment composition for paper, board or other fibrous webs. The composition of the invention comprises particles which comprise an active material and a supporting material. The active material comprises a salt of a multivalent metal, such as a divalent or trivalent metal. In accordance with the invention, the supporting material is adapted to release the active material from the particles when subjected to heat and/or pressure and/or a change in pH. In this way, the active material may be "trapped" in the particles at least until the composition is applied on the surface of the fibrous web and activated or stimulated in a later stage in the paper-making process. Consequently, the active material's adverse effects on the rheology of the composition are avoided while its desired effects on the surface characteristics are retained or enhanced. The invention render it possible to dose a higher concentration of multivalent metals to a sizing or a coating composition without effecting the colloidal stability and hence the rheology of the composition negatively. In this way, the printability of the sized or coated paper or board can be improved. Moreover, use of the particles according to the invention also reduces the concentration of the free anion of the multivalent salt, e.g. a chloride ion, in the composition whereby the risk of corrosion is reduced. In one preferred embodiment of the invention, the multivalent metal salt is calcium chloride.

As used herein, the term "surface treatment composition" relates to a coating or a surface sizing composition or the like.

The active material may alternatively or additionally comprise at least one acid, such as citric acid, per acetic acid, hydrochloric acid or phosphoric acid. In this way, components, such as calcium carbonate, which do not normally comply with low pH, can be used while the benefits of low pH on the printing quality still can be obtained. In one embodiment, the active material comprises a monovalent or a multivalent salt and an acid. In this way, the print quality may be further improved, since the pH reduction and the salt have dual effect on the printing quality.

The supporting material of the particles may be selected from the group consisting of waxes, such as polyethylene waxes, propylene waxes, carnauba wax, micro wax, triglycerides, PEG, metal soaps, and co-polymers of e.g. styrene/acrylate or styrene/butadiene and a combination of any of these. Preferably, the supporting material of the particles is inert and water-resistant, or has a pre-determined solubility rate.

The supporting material may be sensitive to heat and may have a melting point or a glass transition point between a 60-180° C., preferably between 70-110° C. When having a melting or a glass transition point within these intervals, the supporting material can be melted in the drying or calendering of the fibrous web formed by surface treating a web with the inventive composition, whereby the active material may be released from the particles in the drying or calendering section and bloomed to the surface of the web.

The supporting material may alternatively or additionally be sensitive to a pH change. The supporting material may, e.g. be dissolved when subjected to a low pH, such as at a pH below 7, or preferably between 5 and 7. A supporting material that is sensitive to pH could, e.g., be selected from the group of methyl acrylate-methacrylic acid copolymers, cellulose acetate succinate, hydroxyl propyl methyl cellulose phthalate, hydroxyl propyl methyl cellulose acetate succinate, hypromellose acetate succinate, polyvinyl acetate phthalate (PVAP), methyl methacrylate-methacrylic acid copolymers, sodium alignate or stearic acid or mixtures of the above. Stearic acid is an example of a supporting material that is sensitive to both low pH and high temperatures.

The particles may comprise a core comprising the active material, which core is encapsulated in a shell comprising the supporting material. By creating a core-shell structure, more defined particle morphology and better stability in the suspension can be obtained. The shell may be made of the supporting material, e.g. of a co-polymer of styrene/acrylate, which is melted, dissolved or destroyed when subjected to heat and/or pressure and/or a change in pH whereby the material within the core may be released from the particle. The core may comprise the active material in a bonded or in a separate form. The active material may e.g. be particulate, crystalline salt. Alternatively, the core may be a composite of the active material and a binding material. The binding material may be selected from the group consisting of waxes, such as polyethylene waxes, polypropylene waxes, triglycerides and metal soaps. The binding material may have a melting point between 60-180° C., preferably between 70-110° C. The melting point of the binding material may be similar or the same as that of the supporting material. The core may further comprise surfactants and/or chelating agents.

The supporting material may further comprise dispersed finely divided particles of an acid, such as citric acid, per acetic acid, hydrochloric acid or phosphoric acid. In one embodiment, the particles are of a core/shell construction and the core comprises a mono- or multivalent salt as an active material and the cell comprises dispersed finely divided particles of an acid. In this way, both an acid and a salt can be added to a coating/sizing composition that normally is not compatible with low pH and/or a metal salt. When the supporting material is melted, dissolved or destroyed, after the composition is applied on a fibrous web, the acid is released causing a pH reduction whereby the printability is improved. Simultaneously, the salt is released whereby the printability is further improved.

In one embodiment of the invention the particles are composites of a supporting material and an active material. Such a composite particle may, e.g., be formed of a multivalent metal salt as the active material and calcium stearate as the supporting material.

The particles may comprise the active material, e.g. the multivalent metal salt, to an amount of at least 30 wt %, preferably 40-70 w %, most preferably 70-80 w %. In this way, the composition may comprise a high concentration of the active material. Thus, the particles may be added to e.g. coating compositions without causing colloidal destabilization.

The supporting material may be adapted to release the active material from the particles in a subsequent step on the paper machine after the composition has been applied to a surface of a fibrous web. The supporting material may, e.g., be adapted to release the active material in the subsequent drying or calendering of the web. Alternatively, the supporting material may be adapted to release the active material in a printing press at the printing of a paper or board formed by the invention.

The particles may further comprise at least one stabilizer, such as a surfactant or a hydrocolloid. The stabilizer should be selected so that it is compatible with the charge of the other coating or sizing components in the composition. If, e.g., the composition comprises anionic components, the stabilizer should preferably be neutral, amphoteric or anionic.

The present invention is especially advantageous when adding salts of multivalent metals to surface treatment compositions that are anionically charged, since such compositions are especially sensitive to multivalent ions, even at small concentrations.

The surface treatment composition of the invention may further comprise other components commonly used in coating or sizing compositions. The composition may, e.g., further comprise starches, carboxymethylcellulose (CMC), polyvinyl alcohol (PVA), sizing agents commonly used, such as alkylketene dimer (AKD) or acrylic co-polymers. The composition may further comprise acid copolymers, such as methyl acrylate.

The particles' average spherical diameter may be between 100-0.01 μm, preferably between 50-0.1 μm and even more preferably between 10-0.5 μm or between 1-5 μm, or 0.5-1.5 μm. A particle with a spherical diameter within these intervals has about the same size as a pigment particle and would therefore not cause any rheological problems or coating defects in e.g. film press or blade coating.

The invention further relates to a process for the manufacture of a surface-treated and printed paper or board, such as an inkjet or flexographic printed paper or board, or other fibrous webs. Said process comprises the steps of forming a fibrous web from pulp, and coating or surface sizing the fibrous web with at least one layer of the surface treatment composition of the invention. The surface sizing of the fibrous web according to the invention may be applied at the drying section, e.g. in a size press, or at the wet end of the paper machine. The process further comprises the subsequent step of treating the fibrous web so that the active material is released from the particles on the surface of the fibrous web. This may be achieved in a subsequent step in the paper machine, e.g. at the drying or calendering of the surface-treated web or by changing the pH, e.g. by activating acids comprised in the composition by the application of heat. The process further comprises the step of printing the resulting coated or surface sized paper or board by use of inkjet and/or flexographic printing techniques.

The invention further relates to a paper or board product comprising the surface treatment composition described above and a printed paper or board comprising these products, preferably being printed by inkjet and/or flexographic printing techniques. The printed paper or board comprising these paper or board products may preferably be printed with inkjet technique using water based pigmented inks. The invention is, however, not limited to solely inkjet, but can further be used to improve print quality in e.g. flexography where water based dye or pigmented inks are used. The invention is further applicable for hybrid printed products, in which one of the printing methods is based on pigmented water based inkjet inks. Moreover, the invention is also applicable for printing with hybrid inks, which here relates to inks containing both dye and pigment particles.

DETAILED DESCRIPTION OF THE INVENTION

The surface-treatment composition of the present invention comprises particles that comprise high concentrations of active materials, which active materials are released from the particles in a controlled manner after the composition has been applied on the surface of a web. Use of such particles in the composition decreases rheology and viscosity problems that are connected with prior art compositions comprising as high concentrations of the active materials as the inventive composition. Consequently, higher concentrations of the active materials may be used without causing rheology or viscosity problems.

By the expression "release . . . from the particles" as used herein means that the active material is transformed from a state wherein it is held within or in another way being a part of a particle to a state wherein the active material is not a part of a particle form, but in contact with the surface of the web. Thus, the active material might be released from the particle as a separate material, or it might be released from the particle in a bonded form, e.g. bonded or in another way attached to the supporting or binding material.

The invention is especially advantageous when dosing salt of multivalent ions to sizing composition, especially to anionically charged sizing composition, in order to enhance the inkjet printability of a paper or board. Said salts may e.g. be calcium chloride, aluminum chloride, magnesium chloride, magnesium bromide, calcium bromide, barium chloride, calcium nitrate, magnesium nitrate, barium nitrate, calcium acetate, magnesium acetate or barium acetate. Said anionic sizing composition may e.g. comprise anionic rosin soap sizing agents, anionic polymeric styrene maleic anhydride sizing agents or polyaluminium chloride.

The particles of the invention can be of a shell/core construction, with the active material being encapsulated as a core within a shell of a supporting material. Such particles can be manufactured using e.g. an emulsion polymerization method.

Alternatively, the particles may be of a composite construction, comprising a mixture of the active material and the supporting material. For example, instead of forming as shell/core structure, the particles may be a composite of a calcium stearate and calcium chloride. Such a particle may comprise calcium to an amount of 50 weight % or more. A calcium stearate/calcium chloride particle may be formed by mixing calcium stearate with calcium chloride, in a batch process. The formed particles are thereafter stabilized by use of e.g. starch and surfactants.

The particles may also be formed by e.g. dry blending calcium stearate and calcium chloride whereupon the mixture is milled and finally fractionated. The particles can then be stabilized in solution by using the said stabilizing system.

The composite materials can also be created using a spinning method, such as wet spinning, electrospinning or electrospraying. In such a method, a water soluble wax is, e.g., blended with calcium chloride and then spun. The temperature of the solution should preferably be above the melting point of the supporting or binding material, e.g. wax, in order to ensure solubility and blendability with the added components. The materials can be spun or sprayed (particulates) directly onto a substrate or indirect onto another collector plate, or alternatively, into a solution.

The invention claimed is:

1. A process for the manufacture of a surface-treated and printed paper, board or other fibrous web comprising the following steps:

a) forming a fibrous web from pulp, b) coating or surface sizing the fibrous web with at least one layer, wherein the fibrous web is coated or surface sized with a surface treatment composition, which composition comprises particles which comprise an active material comprising a salt of a multivalent metal, an acid, and a supporting material, c) melting or dissolving the supporting material thereby or releasing the active material and the acid from the particles on the surface of the fibrous web by the application of heat, or a change pH, or a change in heat and pressure, or a combination thereof, and d) printing the resulting coated or surface sized paper, board or fibrous web by use of inkjet and/or flexographic printing techniques.

2. The process according to claim 1, wherein the step c) of releasing the active material from the particles is accomplished in drying of the fibrous web.

3. The process according to claim 1, wherein the step c) of releasing the active material from the particles is accomplished in calendering of the fibrous web.

4. The process according to claim 1, wherein the active material comprises calcium salt.

5. The process according to claim 1, wherein the supporting material is selected from the group consisting of waxes, polyethylene waxes, polypropylene waxes, triglycendes, metal soaps, and co-polymers or a combination of any of these.

6. The process according to claim 1, wherein the supporting material is sensitive to heat and has a melting point or a glass transition point of between 60-180° C.

7. The process according to claim 1, wherein the supporting material further comprises dispersed finely divided particles of either citric acid, per acetic acid, hydrochloric acid, phosphoric acid, or combinations thereof.

8. The process according to claim 1, wherein the acid of the active material comprises at least one citric acid, per acetic acid, hydrochloric acid and phosphoric acid.

* * * * *